US005402766A

United States Patent [19]

Tsuchiya et al.

[11] Patent Number: 5,402,766

[45] Date of Patent: Apr. 4, 1995

[54] IGNITION APPARATUS WITH A PRE-GAP

[75] Inventors: Hiromitsu Tsuchiya; Takashi Sato; Tetsuya Mitani, all of Shizuoka, Japan

[73] Assignee: Yazaki Corporation, Tokyo, Japan

[21] Appl. No.: 203,749

[22] Filed: Mar. 1, 1994

Related U.S. Application Data

[63] Continuation of Ser. No. 834,949, Feb. 14, 1992, abandoned.

[30] Foreign Application Priority Data

Feb. 18, 1991 [JP] Japan ..... 3-044098

[51] Int. Cl.[6] ..... F02P 15/00; F02P 15/12

[52] U.S. Cl. ..... 123/627

[58] Field of Search ..... 123/169 EA, 169 G, 625, 123/627; 313/124

[56] References Cited

U.S. PATENT DOCUMENTS 1,341,362 5/1920 Ranney et al. ..... 123/169 EA X
2,797,252 6/1957 Erickson ..... 123/627
3,185,938 1/1940 Crawford ..... 123/627 X
3,995,183 11/1976 Lechner et al. ..... 313/124
4,944,280 7/1990 Washington ..... 123/627

FOREIGN PATENT DOCUMENTS 338452 6/1921 Germany ..... 123/627

*Primary Examiner*—Tony M. Argenbright
*Attorney, Agent, or Firm*—Nikaido, Marmelstein, Murray & Oram

[57] ABSTRACT

Only one pre-gap is arranged between the ignition coil and the distributor so that it is connected in series with each of the ignition plugs in the engine. A relay device is connected in parallel with the pre-gap. The relay device is normally closed to supply a high voltage from the ignition coil to the distributor, bypassing the pre-gap. Only when sensor signals indicate that the air-fuel combustion state is bad, the relay device is opened to cause the high voltage from the ignition coil to be applied to the pre-gap before being supplied to the distributor. This construction permits the single pre-gap to serve all the cylinders in the engine and prolongs the working life of the pre-gap.

1 Claim, 4 Drawing Sheets

IGNITION APPARATUS WITH A PRE-GAP

This application is a continuation of application Ser. No. 07/834,949, filed Feb. 14, 1992, now abandoned.

BACKGROUND OF THE INVENTION

1. Field of the Invention

The present invention relates to an ignition apparatus with a pre-gap for automobile engines and the like.

2. Description of the Prior Art

There has been known a pre-gapped ignition apparatus for automobile engines and the like which has a pre-gap connected in series with an ignition plug that has a discharge gap, in order to prevent the ignition plug from smoldering due to adhering carbons and thereby keep the ignition timing constant (Japanese Patent Publication No. Showa 51-32180).

FIG. 6 shows such a pre-gapped ignition apparatus 1. An ignition coil 2 generates a high voltage on the secondary coil side by interrupting a primary coil current. The high voltage thus produced is supplied through a distributor 3 to cylinders in synchronism with the compression stroke of each cylinder in the engine. Each cylinder is provided with a pre-gap 6 which is connected in series with a discharge gap 5 formed between a center electrode and a ground electrode of the ignition plug 4. The pre-gap 6 is installed inside the ignition plug 4.

As shown in FIG. 7, the ignition plug 4 has the center electrode 7 and the ground electrode 8 at one end and, at the other end, a terminal 9 which is connected to a plug cap formed at the end of a high-voltage cable extending from the distributor 3. An insulator 10 of the ignition plug 4 is formed with a center hole 11 extending therethrough from the center electrode 7 to the terminal 9. The pre-gap 6 is placed in the center hole 11 in such a way as to connect the center electrode 7 and the terminal 9. The pre-gap 6 is made up of a pair of discharge electrodes 12, 13 sealed in a glass tube 14 filled with an inert gas at a specified pressure.

In the ignition apparatus 1, the pre-gap 6 is inserted immediately before and in series with the discharge gap 5 of the ignition plug 4, so that a high discharge voltage of the pre-gap 6 is applied to the center electrode 7 of the ignition plug 4, thus providing a required ignition voltage high enough to effect normal firing without being affected by carbon adhering to the ignition plug 4.

SUMMARY OF THE INVENTION

The above-mentioned conventional ignition apparatus 1 with a pre-gap, however, has the following drawbacks. Since the pre-gap 6 is incorporated in the ignition plug 4, all the ignition plugs 4 must each be provided with one pre-gap 6, i.e., the same number of pre-gaps 6 as the ignition plugs 4 must be prepared, increasing the production cost.

Furthermore, since the pre-gap 6 continues repetitive discharging without interruption during engine operation, the accumulated number of discharges becomes significantly large. Making the pre-gap 6 with a sufficient durability to withstand the large number of discharges inevitably increases the production cost. Another disadvantage is that since the pre-gap 6 is incorporated in the ignition plug 4, there is a limitation on the size of the pre-gap, making its manufacture difficult.

While the above-mentioned pre-gapped ignition apparatus 1 has the pre-gap 6 incorporated in each of the ignition plugs 4, there is another type in which the pre-gap 6 is fitted to a plug cap. This case also has the similar problems.

The present invention has been accomplished under the aforementioned circumstances and is intended to provide a pre-gapped ignition apparatus which serves all the cylinders of the engine with a single pre-gap and which can extend the working life span of the pre-gap.

To achieve the above objective, the ignition apparatus with a pre-gap according to this invention comprises: a plurality of ignition plugs with discharge gaps, one for each cylinder in the engine; an ignition coil for generating a high voltage; a distributor for distributing the high voltage generated by the ignition coil to the ignition plugs; a single pre-gap connected in series with each of the discharge gaps of the ignition plugs, the pre-gap being arranged between the ignition coil and the distributor; and a bypass circuit connected in parallel with the single pre-gap to supply the high voltage from the ignition coil to the pre-gap according to the combustion state in the engine.

With this invention, a high voltage generated by the ignition coil and discharged by the pre-gap is applied through the distributor to each ignition plug of the engine only when the combustion state of the engine is bad. In other cases, the high voltage from the ignition coil bypasses the pre-gap via a bypass circuit and is applied to the plugs.

DETAILED DESCRIPTION OF PREFERRED EMBODIMENT

Figure 1:
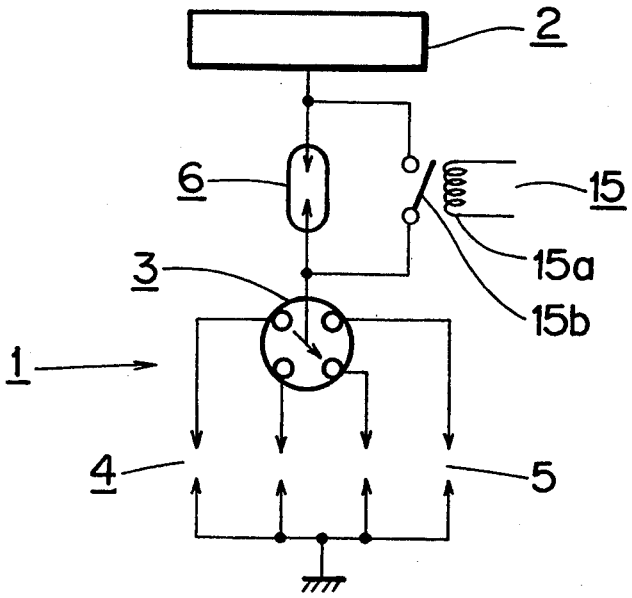
FIG. 1 is a schematic diagram of one embodiment of the invention.
Figure 4:
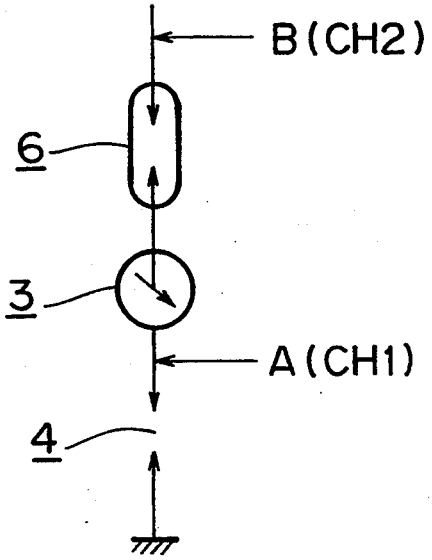
FIG. 4 is a schematic diagram of the ignition apparatus having the characteristic of FIG. 2.

By referring to FIGS. 1 to 5, one embodiment of the invention will be described in detail. In the figures, parts identical to those of the conventional apparatus are given like reference numerals.

FIG. 1 shows one embodiment of this invention. An ignition coil 2 generates a high voltage on the secondary coil side by interrupting a current in the primary coil. The high voltage thus generated is distributed through the distributor 3 to each cylinder of the engine in synchronism with the compression stroke of each cylinder in the engine (Figure shows a four-cylinder engine). Each cylinder has an ignition plug 4 with a specified discharge gap 5. The high voltage supplied from the distributor 3 produces a spark in the discharge gap 5, firing the air-fuel mixture in the cylinder.

Between the ignition coil 2 and the distributor 3 is inserted a single pre-gap 6 which is series-connected with each of the ignition plugs 4. When the pre-gap 6 discharges, the voltage is applied through the distributor 3 to each ignition plug 4.

The pre-gap 6 has a pair of discharge electrodes sealed in an insulation tube filled with an inert gas at a specified pressure, a configuration similar to the common discharge tube. The pre-gap 6 is removably installed in a housing (not shown) between its electrode terminals. The housing is located at a specified position in the engine room, away from the cylinder head which is a grounded body. One of the electrode terminals of the housing is connected to a high-voltage cable coming from the ignition coil 2 and the other electrode terminal is connected to a high-voltage cable going to the distributor 3.

Further, between the ignition coil 2 and the distributor 3 is arranged a relay device 15, which forms a bypass circuit running in parallel with the pre-gap 6. The relay device 15 receives signals from an oxygen sensor, water-temperature sensor and the like (not shown) located at specified positions in the engine. In the relay device 15, a coil 15*a* is normally not energized and its switch 15*b* remains closed, so that the high voltage from the ignition coil 2 bypasses the pre-gap 6 and is supplied to the distributor 3. When the signals from the sensors indicate that the combustion state of the air-fuel mixture in the cylinder is bad (as during engine starting or immediately thereafter), the coil 15*a* of the relay device 15 is energized to open the switch 15*b* . As a result, the high voltage from the ignition coil is applied to the gap 6 before being supplied to the distributor 3.

Figure 5:
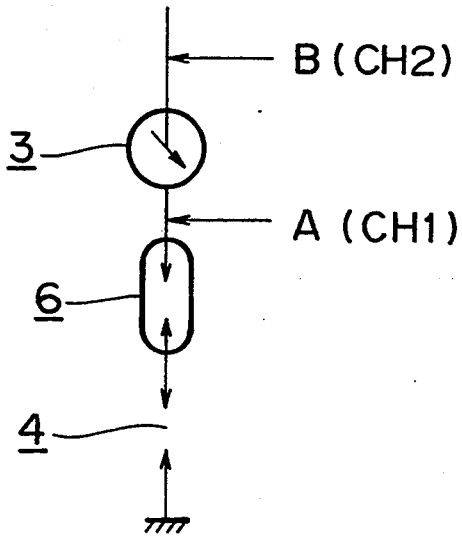
FIG. 5 PRIOR ART
FIG. 5 is a schematic diagram of the ignition apparatus having the characteristic of FIG. 3.
Figure 2:
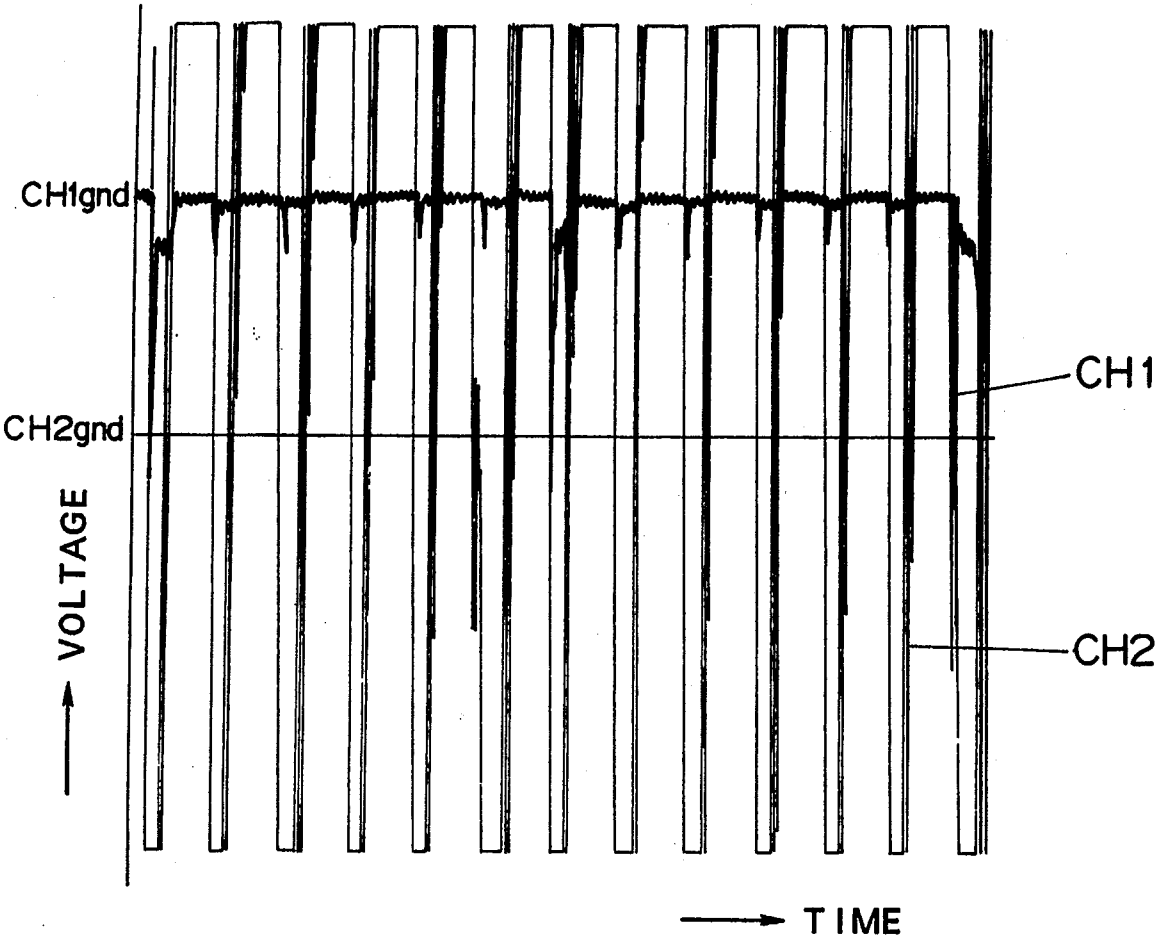
FIG. 2 is a graph showing the actually measured voltage-time relationship in an ignition apparatus of the invention.
Figure 3:
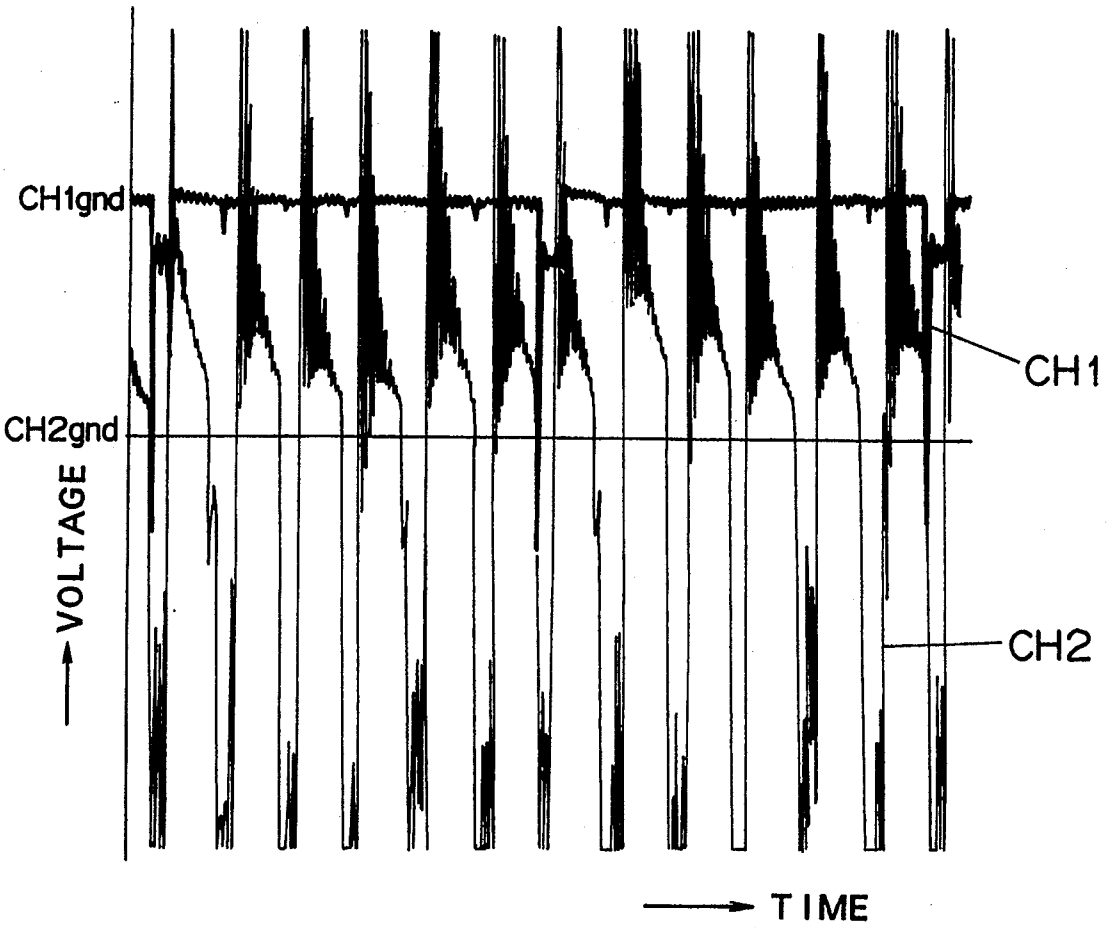
FIG. 3 PRIOR ART
FIG. 3 is a graph showing the actually measured voltage-time relationship in a conventional ignition apparatus.
Figure 6:
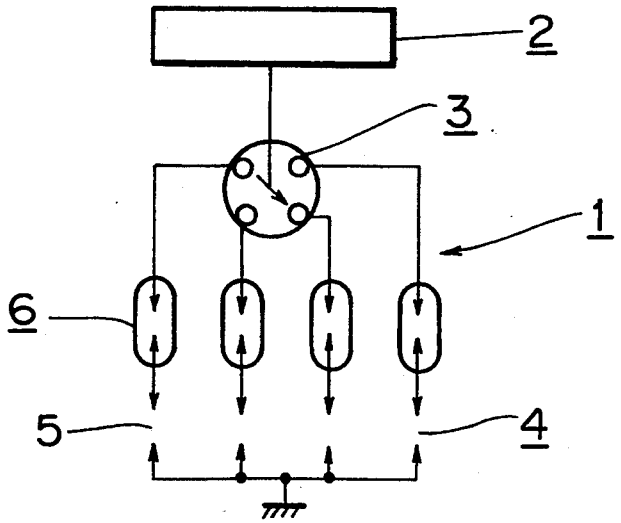
FIG. 6 PRIOR ART
FIG. 6 is a schematic diagram of a conventional pre-gapped ignition apparatus.
Figure 7:
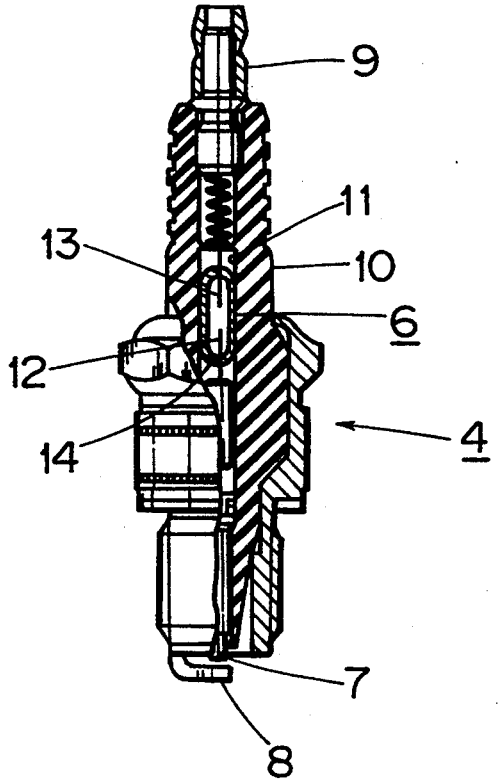
FIG. 7 PRIOR ART
FIG. 7 is a cross section of a conventional ignition plug.

FIG. 2 shows a voltage-time characteristic measurement at the revolution speed of 5000 rpm of a 6-cylinder engine which has a pre-gapped ignition apparatus (FIG. 4) of this invention. FIG. 3 shows a measured voltage-time characteristic at the same revolution speed of the same type of engine as in FIG. 2 but with a conventional pre-gapped ignition apparatus (FIG. 5). In both diagrams, CH1 represents an output voltage of the distributor 3 (point A in FIGS. 4 and 5) for a particular cylinder of the engine and CH2 indicates an output voltage of the ignition coil 2 (point B in FIGS. 4 and 5).

These diagrams show that the output voltage CH1 of the distributor 3 for a particular cylinder rises at the same point on the time charts for both this invention and the conventional pre-gapped ignition apparatus. This means that the location of the pre-gap 6 does not affect the voltage rise timing, which has been experimentally proven, and hence there is no problem in terms of the synchronization with the distributor.

In this embodiment, only one pre-gap 6 is inserted between the ignition coil 2 and the distributor 3, and the relay device 15 is connected in parallel with the pre-gap 6 to apply high voltage from the ignition coil 2 to the pre-gap 6 according to the combustion state of the air-fuel mixture in the engine. This configuration needs only one pre-gap 6 as opposed to the conventional ignition apparatus in which each ignition plug 4 or plug cap has one pre-gap 6 incorporated therein. The remarkable reduction in the number of the pre-gaps permits a substantial reduction in the overall production cost of the ignition apparatus.

Since a discharge is made to occur in the pre-gap 6 by the operation of the relay device 15 to apply voltage through the distributor 3 to each ignition plug 4 only when the combustion condition in the engine is bad and a strong arc is needed, a sufficiently high ignition voltage can be produced to effect normal ignition without being affected by carbon adhering to the ignition plug 4. At the same time, when a high ignition voltage is not required, the pre-gap 6 is bypassed and no discharge is produced. As a result, the pre-gap 6 is prevented from repetitively discharging without interruption during the engine operation, significantly reducing the total number of discharges that occur in the pre-gap 6. This contributes to elongating the life of the pre-gap 6.

Further, the pre-gap 6 is removably mounted in a housing installed between the ignition coil 2 and the distributor 3 rather than being incorporated in the ignition plug 4 as in the conventional ignition apparatus. This construction eliminates restrictions on the size of the pre-gap 6 that accompany the conventional apparatus, thus facilitating the manufacture of the pre-gap 6.

Moreover, since the housing in which the pre-gap 6 is mounted is located away from the cylinder head a grounded body, there is no possibility of electric leakage between the pre-gap 6 and the cylinder head. This eliminates the need to mold the pre-gap 6 with an electrically insulating material to prevent leakage between the grounded body and the pre-gap 6 as is necessary with the conventional apparatus in which the pre-gap is incorporated in the ignition plug 4 arranged close to the cylinder head. This in turn allows only the pre-gap 6 to be replaced improving maintainability.

As mentioned above, the pre-gapped ignition apparatus of this invention has only one pre-gap arranged between the ignition coil and the distributor and also has a bypass circuit connected in parallel with the pre-gap to supply a high voltage from the ignition coil to the pre-gap depending on the operating condition of the engine. Since the number of the pre-gaps needed is only one, which represents a substantial reduction from the number required by the conventional ignition apparatus which incorporates the pre-gap in each ignition plug, the overall cost of manufacturing the ignition apparatus is significantly reduced. Furthermore, since the discharge in the pre-gap can be made to occur only when necessary by means of the bypass circuit, the total number of discharges that occur in the pre-gap can be lowered greatly, helping to prolong the life of the pre-gap.

What is claimed is:

1. An ignition apparatus with a pre-gap comprising:

a plurality of ignition plugs with discharge gaps, one for each of cylinder of an engine;

an ignition coil for generating a high voltage;

a distributor for distributing the high voltage generated by the ignition coil to the ignition plugs;

a single pre-gap connected in series with each of the discharge gaps of the ignition plugs, said pre-gap being arranged between the ignition coil and the distributor; and a bypass circuit connected in parallel with the single pre-gap to supply the high voltage from the ignition coil to the pre-gap based upon a combustion state in the engine, wherein said bypass circuit comprises a relay device having a coil and a switch, said coil being normally not energized causing said switch to remain closed so that the high voltage from the ignition coil bypasses the pre-gap and is supplied to the distributor, said coil being energized to open said switch when the combustion state in the engine is deteriorated so that the high voltage from the ignition coil is applied to the pre-gap before being supplied to the distributor.

* * * * *